United States Patent [19]

Leach

[11] 4,312,459

[45] Jan. 26, 1982

[54] PAINT CAN RIM COVER AND LID COMBINATION

[76] Inventor: Albert E. Leach, 1924 Ridge Rd., Highland Park, Ill. 60035

[21] Appl. No.: 79,338

[22] Filed: Sep. 27, 1979

[51] Int. Cl.[3] ..... B65D 43/10; B65D 41/62; B65D 43/06; B65D 25/10

[52] U.S. Cl. ..... 220/256; 220/259; 220/306; 220/354; 220/90; 220/93

[58] Field of Search ..... 220/354, 90, 93, 375, 220/306, 254, 307, 259, 256

[56] References Cited

U.S. PATENT DOCUMENTS

| | | | |
|---|---|---|---|
| 1,978,025 | 10/1934 | McCown | 220/93 |
| 2,104,540 | 1/1938 | Hoffman | 229/43 |
| 2,151,895 | 3/1939 | Carlson | 220/90 |
| 2,167,619 | 8/1939 | Bainton | 220/93 |
| 2,268,241 | 12/1941 | Brueckel | 220/90 |
| 2,418,502 | 4/1947 | Ferguson | 220/90 |
| 2,591,482 | 4/1952 | Weltich | 220/90 |
| 2,873,052 | 2/1959 | Atherton | 222/570 |
| 3,168,962 | 2/1965 | Rawlins et al. | |
| 3,181,725 | 5/1965 | Friedl | 220/375 |
| 3,428,213 | 2/1909 | Stephens | 220/90 |
| 3,469,735 | 9/1969 | Burt | 220/90 |
| 3,543,287 | 11/1970 | Henkel | 220/90 |
| 3,894,650 | 7/1975 | Crump | 220/90 |
| 3,941,275 | 3/1976 | Simmons | 220/256 |
| 3,980,213 | 9/1976 | Ramsay | 222/485 |
| 4,125,210 | 11/1978 | Embree | 222/570 |

*Primary Examiner*—George E. Lowrance

*Attorney, Agent, or Firm*—Wegner, Stellman, McCord, Wood & Dalton

[57] ABSTRACT

A paint can rim cover and lid combination for use with a paint can having a rim defining a top opening for the can including an annular rim cover of flexible material having a channel-shaped cross section of a width approximating that of the rim to provide inner and outer circular flanges in spaced parallel relation with an interconnecting flat base, each of the flanges is extendable downwardly relative to a paint can and has an inwardly facing annular recess intermediate the height thereof to snap onto the inner and outer periphery of the rim, with the interconnecting base spanning the rim for sealing of the rim, a lid of flexible material having a circular panel section and a depending peripheral flange with the panel section having a diameter at least equal to the outer diameter of the rim cover whereby the lid may be fitted on the rim cover with the depending peripheral flange overlapping the outer circular flange and with there being interengaging structure on the outer circular flange of the rim cover and the lid for releasably locking the lid to the rim cover.

1 Claim, 6 Drawing Figures

31
50
65
3-3
85
80
4-4
60
86
30
81
82
11
5-5
21
20
10
6-6
18
51
61
37
38
40
35
42
41
43
36
16
17
12
15
70
71
72
73

PAINT CAN RIM COVER AND LID COMBINATION

BACKGROUND OF THE INVENTION

This invention pertains to a paint can rim cover and lid combination which seals the paint cam rim against entry of paint thereinto during use of the paint can and which enables sealed temporary storage of the paint can with a lid which is interlocked with the rim cover and which facilitates resealing of the paint can by the original can lid. Additionally, a flexible sealing member can be placed on the paint surface within the can to seal the paint surface from exposure to air during storage of the paint.

In recent times, increasing numbers of people are doing exterior and interior painting and become involved with the handling of paint and paint cans. A typical paint can has a rim provided with a groove for receiving a part of the can lid. This groove presents problems in resealing of the can lid to the can because paint can collect in the groove either as a result of stirring of the paint, pouring of the the paint into another container, or using the edge of the rim as a surface against which the brush is wiped to remove excess paint from the brush. Unless this paint is removed from the groove, the paint can be caused to squirt out from the groove when the cover is replaced and a collection of dried paint prevents subsequent tight sealing of the can lid to the can.

A number of prior art devices have attempted to preclude paint from entering the rim groove and have been devices which are fitted onto the rim of the paint can and are then left in place during painting whereby the opening into the paint can is of a reduced size and makes it more difficult to work out of the paint can.

The prior art devices have not provided a paint can rim cover which will closely fit a variation of paint can rims and effectively seal the groove thereof against entry of paint and which is usable in combination with a lid other than the original can lid to provide a secure closure for temporary storage.

SUMMARY OF THE INVENTION

A primary feature of the invention disclosed herein is to provide a paint can rim cover and lid combination for use with a paint can wherein the rim cover can releasably lock to the paint can rim and seal the groove thereof and a lid may be securely fastened to the rim cover for temporary storage and with long-term storage of the paint within the can being facilitated by use of a sealing member which is placeable on the top surface of the paint to prevent the paint surface being exposed to air and with the groove of the paint can rim being clean for good, tight placement of the original can lid on the paint can.

An object of the invention is to provide a paint can rim cover and lid combination which facilitates saving partial amounts of paint in the can without any drying of the paint and which enables replacement of the original can lid in good, tight sealing relation with the paint can.

Another object of the invention is to provide a new and improved paint can rim cover and lid combination of an inexpensive and simple construction which will coact with most commercially-available paint cans of a particular capacity.

Still another object of the invention is to provide a combination, as defined in the preceding paragraph, which provides secure temporary storage for the paint can with the paint can rim cover releasably locking to the rim of the paint can and the lid releasably locking to the rim cover.

DESCRIPTION OF THE PREFERRED EMBODIMENT

Figures 1, 2, 3, 4, 5, 6, 7:
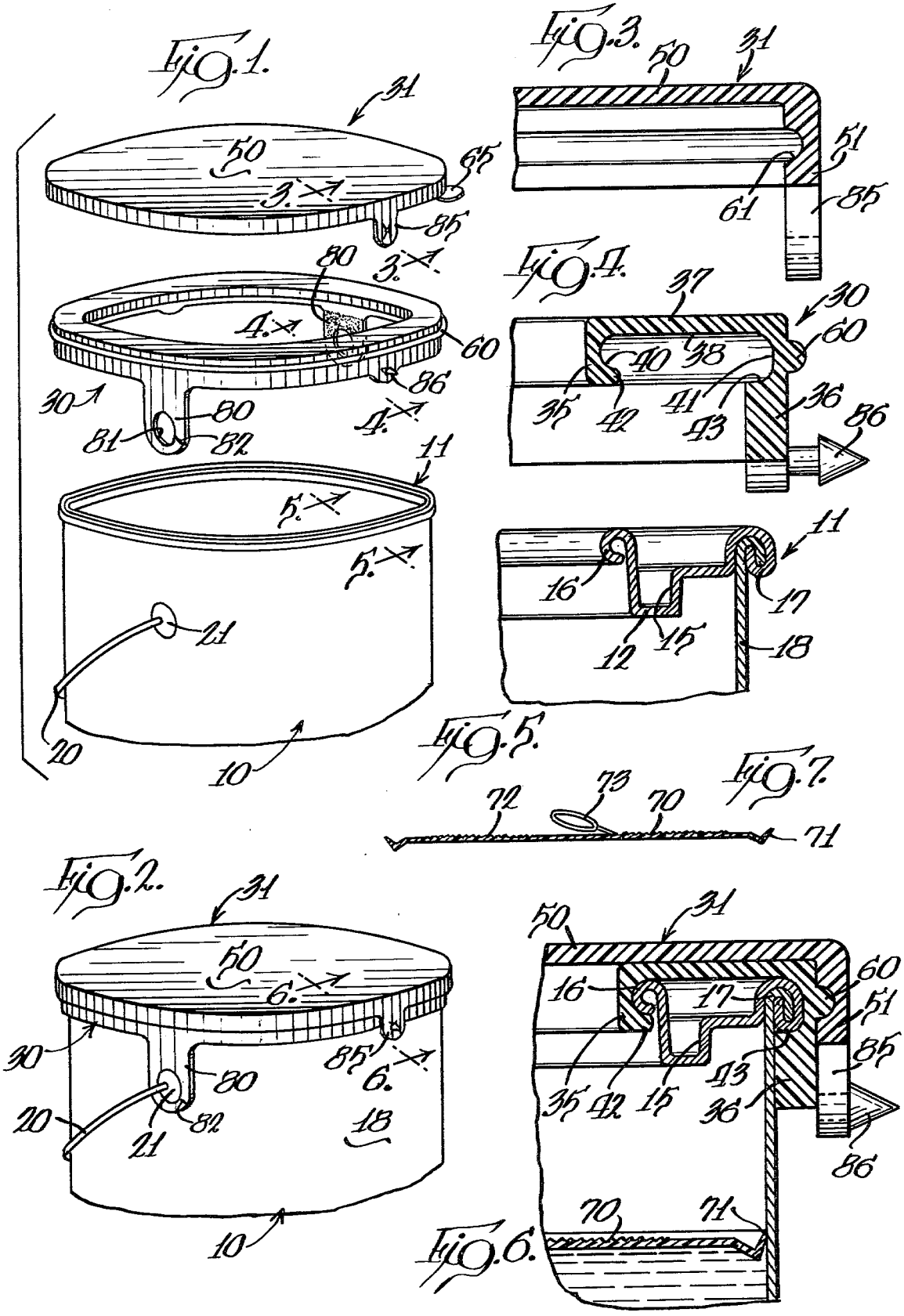
FIG. 1 is an exploded, perspective view of the paint can rim cover and lid combination shown in relation to an upper part of a paint can.
FIG. 2 is a view, similar to FIG. 1, showing the paint can rim cover and lid in association with the paint can.
FIG. 3 is a fragmentary section, on an enlarged scale taken generally along the line 3—3 in FIG. 1.
FIG. 4 is a fragmentary section, on an enlarged scale taken generally along the line 4—4 in FIG. 1.
FIG. 5 is a fragmentary section, on an enlarged scale taken generally along the line 5—5 in FIG. 1.
FIG. 6 is a fragmentary section, on an enlarged scale, taken generally along the line 6—6 in FIG. 2.
FIG. 7 is a perspective view of a sealing device placeable on the upper surface of the paint within a paint can.

A typical paint can is partially shown in FIGS. 1 and 2 and with a rim part thereof shown in FIGS. 5 and 6. The paint can 10 has a rim, indicated generally at 11, which may be formed as shown particularly in FIG. 5 by means of a formed annular member 12 provided with an annular groove 15 as well as an inner peripheral bead 16 and an outer peripheral bead 17 which is formed into interlocking contact with an upper end of the wall 18 of the paint can. The formation of the rim, as well as dimensions of the rim may vary slightly with a paint can of the same capacity, dependent on the can manufacturer, and the showing in the drawings is merely illustrative of one type of paint can construction. Additionally, the paint can has a bail or handle 20 which is pivotally associated with the paint can at two spaced pivot mountings with one mounting being indicated at 21. The original can lid is not shown in the drawings because of its conventional structure. The can lid coacts with the paint can rim by positioning of depending lid parts intermediate the beads 16 and 17 of the rim.

There is a tendency for paint to enter the rim groove 15 when stirring a relatively full can of paint or when pouring paint from one can into another, as well as during painting by wiping a brush edge against the rim bead 16. Removal of all paint from this groove is difficult and time-consuming and at a later time replacement of the original can lid can result in squirting wet paint out of the rim groove 15. Such paint as remains in the groove eventually dries out and repeated removal and replacement of the can lid does not result in a tight seal whereby air can reach the paint within the can and cause drying of the paint.

A paint can rim cover and lid combination, as disclosed herein, embodies a rim cover, indicated generally at 30, and a lid, indicated generally at 31. The rim cover 30 is an annular member of flexible material, such as molded plastic, having a channel-shaped cross section, as shown particularly in FIGS. 4 and 6 and, more particularly, of a generally L-shaped cross section to provide an inner circular flange 35 and a wider outer circular flange 36 which are in spaced parallel depending relation from an interconnecting base 37 having a flat inner surface 38. The channel cross section of the rim cover has a width approximating that of the width of the paint can rim and each of the circular flanges has an inwardly-facing annular groove intermediate the height thereof with the inner circular flange 35 having the groove 40 and the outer circular flange having the groove 41. These grooves result in the formation of lips 42 and 43, respectively, whereby the rim cover can be moved downwardly over the paint can rim and snapped into position with the rim beads 16 and 17 fitted in the grooves 40 and 41, respectively, and with the rim cover substantially locked into position by the lips 42 and 43 engaging under the rim beads. The interconnecting base 37 spans the space between the rim beads and closes off the rim groove 15. With the rim cover in place, a desired amount of paint can be poured from the paint can 10 into another container and the rim cover is wiped off with a dry brush or rag.

For temporary or overnight storage, the lid 31 is then associated with the paint can and the rim cover 30.

The lid 31 is formed of flexible material, such as a molded plastic, and has a circular panel section 50 and a depending peripheral flange 51. The panel section 50 is of a diameter at least equal to the outer diameter of the rim cover 30 whereby the lid may be fitted on the rim cover, with the depending peripheral flange 51 positioned in overlapped relation with the outer circular flange 36 of the rim cover, as shown in FIG. 6. This results in the underside of the lid having a circular area of contact with the rim cover base 37.

To assure that a good closure is made for temporary storage of the paint, the lid 31 is securely, but releasably, fastened to the rim cover 30 by interlocking means on these parts, including a protruding bead 60 extending around said outer circular flange of the rim cover intermediate the height thereof and which interengages with a matching groove 61 formed in an inner face of the depending peripheral flange 51 of the lid. If the paint can should be knocked over, the paint is retained therein because of the tight fitting of the rim cover to the paint can and the interlocking of the lid 31 to the rim cover. Access to the paint is obtained by removal of the lid which is facilitated by engagement of a tab 65 extending outwardly from the flange of the lid which enables sufficient deformation of the lid to release the interlocking means.

When extended shelf storage of a paint can is desired, the rim cover 30 is first removed from the paint can by flexing thereof. Thereafter, a sealing device, as shown in FIG. 7, is moved into position against the top surface of the paint in the can. The sealing device 70 is shown in association with the paint in the can in FIG. 6. The sealing device 70 is a circular member, preferably of a clear plastic material, whereby the color of paint therebeneath can be visually determined through the sealing device and with the plastic material being one which will not react to a paint thinner or solvent over an extended period of time when in contact therewith. The periphery of the sealing device has a flexible sealing edge 71 to engage against the interior of the paint can wall 18 and is also provided with a rough upper surface, as indicated at 72, whereby, with the sealing device being flexible, it can be gripped between the fingers and slightly folded for placement in the can or removal from the can. Alternatively, an integrally-molded finger ring 73 can be provided to facilitate handling of the sealing device.

After the sealing device has been moved into position against the paint surface to prevent exposure of the surface to air, the original can lid is securely attached to the paint can rim in a conventional manner and in good, sealed relation therewith. This process can be repeated several times, since paint does not collect in the groove 15 of the paint can rim and there can always be a good, tight seal of the original can lid to the paint can.

From the foregoing, it will be seen that a paint can rim cover and lid combination has been provided which can be quickly and easily snapped into place, with the lid engaging the outer periphery of the rim cover for good, interlocking action. The interlocking action takes place in an area which is free of paint in the event a painter uses the paint can with the rim cover attached thereto. The construction is usable with paint cans which may have some variations in the structure and dimensions thereof, particularly the paint can rim. Reliable storage of the paint in the paint can is assured because of the good interlocking relation between the components. Long-term storage without the paint drying out is achieved by maintaining the paint can rim groove free of paint for good sealing of the original can lid to the paint can and with the sealing device positioned on the top surface of the paint within the can.

Additional structure for even more secure attachment of the components includes a pair of depending ears on the rim cover 30 which interlock with the pivot mountings 21 on the can 10. One of the ears is shown in FIG. 1 at 80 and has an opening 81 to fit over the pivot mounting 21. A slit 82 renders the ear more flexible and enables the ear to move past the bail 20. The lid 31 has one or more depending apertured ears 85 which can snap onto headed plugs extending outwardly from the circular flange 36 of the rim cover with one of the headed plugs being shown at 86.

I claim:

1. A paint can rim cover and lid combination for use with a paint can having a rim with inner and outer peripheral beads and an intermediate annular groove defining a top opening for the can comprising, an annular rim cover of molded plastic material having a generally L-shaped cross section to provide inner and outer circular flanges in spaced parallel depending relation with an interconnecting base having a planar upper surface with said circular flanges extending generally normal thereto, each of said flanges extending downwardly relative to a paint can and having an inwardly facing annular groove intermediate the height thereof to snap onto and fit around the inner and outer peripheral beads of the rim with the interconnecting base spanning the groove of the rim for sealing of said groove and with the outer circular flange having a width to extend downwardly along the side of the paint can, a lid of molded plastic material having a circular planar panel section and a depending peripheral flange with said panel section having a diameter at least equal to the outer diameter of the rim cover whereby said lid may be fitted on said rim cover with the depending peripheral flange overlapping and extending along said outer circular flange and with said planar panel section in a circular area of contact with the upper surface of the rim cover base, and interlocking means of said rim cover and lid including a protruding bead extending around said outer circular flange of the rim cover at a location to be below the top of the paint can and reinforced against inward movement by the paint can and a matching groove formed in an inner face of the depending peripheral flange of the lid.

* * * * *